US006398909B1

(12) United States Patent
Klerelid

(10) Patent No.: US 6,398,909 B1
(45) Date of Patent: Jun. 4, 2002

(54) METHOD AND APPARATUS FOR IMPRINTING, DRYING, AND REELING A FIBROUS WEB

(75) Inventor: Ingvar Klerelid, Karlstad (SE)

(73) Assignee: Valmet-Karlstad Aktiebolag, Karlstad (SE)

( * ) Notice: Subject to any disclaimer, the term of this patent is extended or adjusted under 35 U.S.C. 154(b) by 50 days.

(21) Appl. No.: 09/596,187

(22) Filed: Jun. 16, 2000

Related U.S. Application Data

(60) Provisional application No. 60/141,682, filed on Jun. 30, 1999.

(30) Foreign Application Priority Data

Jun. 17, 1999 (SE) ..... 9902351

(51) Int. Cl.[7] ..... D21H 25/04; D21F 5/00; D21F 25/00; F26B 7/00

(52) U.S. Cl. ..... 162/109; 162/117; 162/204; 162/206; 162/118; 162/305; 162/358.3; 162/359.1; 162/360; 162/361; 34/400; 34/242; 34/160; 34/370

(58) Field of Search ..... 162/358.1, 358.3, 162/358.4, 358.5, 359.1, 360.2, 360.3, 361, 204–207, 140, 109, 117, 11, 118, 121, 122, 289, 305; 34/397–400, 405, 414, 419, 444, 481, 620, 69, 114, 115, 619, 122; 242/160.1, 370, 159

(56) References Cited

U.S. PATENT DOCUMENTS 1,883,526 A * 10/1932 Bryan ..... 162/117

(List continued on next page.)

FOREIGN PATENT DOCUMENTS

| | | |
|---|---|---|
| DE | DE 42 16 264 | 11/1993 |
| WO | 93/23614 | * 11/1993 |

*Primary Examiner*—Jose Fortuna
(74) *Attorney, Agent, or Firm*—Alston & Bird LLP

(57) ABSTRACT

An apparatus for imprinting, drying, and reeling a fibrous web comprises a hot press including a pair of press members forming a nip therebetween for passage of the web therethrough and at least one clothing arranged to pass through the nip of the press with one side of the web in contact with a surface of the at least one clothing. The apparatus also includes a heat transfer device defining a heatable surface, the heat transfer device being arranged to pass through the nip of the press with the opposite side of the web in contact with the heatable surface, and a heating device operable to heat the heat transfer device such that the heat transfer device heats and dries the web during contact therewith. The apparatus further includes a reel-up including a rotatable reel spool onto which the web is reeled to form a finished roll of web material. At least one of the clothing surface and the heatable surface comprises an imprinting surface for imparting a textured surface to the side of the web in contact therewith in the nip of the hot press. The heat transfer device is arranged to support the web from the press substantially to the reel spool, and can comprise a surface of a surface winding drum, or a substantially rigid sleeve loosely encircling a rotatable roll or a flexible belt looped about a rotatable roll. The reel spool preferably is in nipping engagement with the heat transfer device.

26 Claims, 6 Drawing Sheets

U.S. PATENT DOCUMENTS 3,198,695 A * 8/1965 Justus ..... 162/359.1
3,981,084 A * 9/1976 Sobota ..... 34/123
4,144,124 A * 3/1979 Turunen et al. ..... 162/290
4,309,246 A * 1/1982 Hulit et al. ..... 162/113
4,324,613 A 4/1982 Wahren
4,720,325 A * 1/1988 Rausing et al. ..... 162/110
5,393,384 A 2/1995 Steiner et al.
5,439,559 A * 8/1995 Crouse ..... 162/358.5
5,556,511 A * 9/1996 Bluhm et al. ..... 162/206
5,701,682 A 12/1997 Chuang et al.
5,776,307 A 7/1998 Ampulski et al.
5,795,440 A * 8/1998 Ampulski et al. ..... 162/117
5,830,316 A 11/1998 Ampulski
5,855,739 A * 1/1999 Ampulski et al. ..... 162/117
5,935,381 A * 8/1999 Trokhan et al. ..... 2/109
6,051,105 A * 4/2000 Ampulski ..... 162/117
6,182,375 B1 * 2/2001 Banerjee ..... 34/398
6,221,214 B1 * 4/2001 Kotitschke et al. ..... 162/210

* cited by examiner

METHOD AND APPARATUS FOR IMPRINTING, DRYING, AND REELING A FIBROUS WEB

CROSS-REFERENCE TO RELATED APPLICATION

This application claims the benefit of U.S. Provisional Patent Application Ser. No. 60/141,682, filed Jun. 30, 1999, and Swedish Patent Application No. 9902351-7, filed Jun. 17, 1999.

FIELD OF THE INVENTION

The present invention relates to methods and apparatus for processing a wet web of fiber material with a cellulose content, preferably a soft paper web, so as to imprint the web to impart a desired surface structure to the web and to dry the web, and for reeling the imprinted and dried web into a roll.

BACKGROUND OF THE INVENTION

In conventional production of paper, a continuous web is formed from a suspension of pulp delivered onto a moving wire, and the web with originally a very high water content is partially dewatered on a wire to form a wet web with at least some degree of coherence, although the fibers are still capable of undergoing rearrangement at this stage of the paper making process. The wet web is then fed to a press section, comprising one or several wet presses each having at least one roll nip through which the web runs, and in which roll nip still more water is mechanically pressed out of the web. The web is then made to pass through a drying section in which remaining water is evaporated to a predetermined dry solids content for the web through a supply of heat. Finally, the web is reeled up into a finished material reel or roll in a reel-up. At all web transfers between two consecutive machine sections, the web must transferred from one drive section to the next over an open or closed draw. If the web in the draw lacks support from a belt or the like then the draw is termed an open draw. At the open draw the web must bear its own weight and also be able to tolerate increased tensions caused by speed differences between the drive sections in question. The risk for web breakage in an open draw is high and therefore open draws should be avoided.

In recent years press sections have been developed that have made it possible to transfer the web from the forming section of the paper machine through all roll nips without any considerable tension on the wet paper web. Through the gradual increase of the dry solids content of the web, the strength of the web grows continually during its passage through the press section. Nevertheless, the web still is sensitive to the increased tensions, which occur at transfers between different sections of production. Furthermore, in a conventional wet press, rewetting of the web tends to occur at the outlet of every roll nip, which negates some of the gained strength of the web.

Accordingly, it would be desirable to provide a higher dry solids content of the wet web at an earlier stage of the production process. It would also be desirable to eliminate transfers and open draws throughout the pressing, drying, and reeling operations of a papermaking process, which would facilitate a higher web velocity and thereby a substantial increase in production with subsequent benefits for the paper industry. It would also be desirable to provide such benefits while also providing a higher bulk for soft paper and better quality in the final product.

Furthermore, in production of paper, board, and cardboard, currently it is common to have a very elongated drying section with a great number of drying cylinders and guide rolls that alternate with each other, around which the wet web runs during heating and evaporation of water. In production of soft paper, which has lower grammages and which for instance is used for production of household paper, paper towels and other hygiene products, it is more typical to employ a drying section that comprises either a single drying cylinder with a relatively large diameter (e.g., up to 6 m in diameter) and with a polished mantle surface that is steam heated from its inner side. i.e. a so called Yankee dryer, or a combined machine which consists of both a Yankee dryer and a number of common drying cylinders in succession. Consequently, these machines employing a large number of drying cylinders tend to be quite long.

However, attempts have been made to reduce one or several of the problems mentioned above. For instance, from U.S. Pat. No. 4,324,613 it is known that pressing of a wet web in a hot press simultaneously at increased temperature and high pressure leads to several favorable effects, e.g., a considerably increased dewatering speed and thereby a shortened drying section. The term "hot press" which is used in the present context and which constitutes an integration between a press and a drying arrangement is improperly named by many an "impulse dryer." The patent describes a roll nip that is formed between two cylindrical rolls movable towards each other, one of the rolls being heated from the outside to a high surface temperature. The simultaneously applied high temperature and high-pressure give a high thermal flow to the web, which results in a high dewatering speed. The good dewatering most likely results in part from the considerable steam generation at the roll nip, which helps to blow or force remaining liquid out of the web, and from the increased temperature that reduces the water viscosity so that it is more easily pressed out of the web. Additionally, the water, which during the exertion of the roll nip pressure attains a temperature in excess of 100° C., rapidly evaporates when the pressure rapidly drops as the web exits the roll nip.

However, in a conventional roll nip the dwell time for the paper web is too short in order to get any real benefits from the favorable effects of the hot pressing. However, from U.S. Pat. No. 5,393,384 it is known to employ a shoe press with a concave press shoe that acts against a heated drying cylinder and forms an elongated nip through which the web passes. Since the nip of the shoe press is extended to approximately 20 to 30 cm, the dwell time of the web in the nip is substantially extended relative to a roll press, so that the web is subjected to high pressure and temperature for a much longer period of time.

Furthermore, when producing soft paper such as tissue, there is generally a desire to attain a web with a high bulk (i.e., ratio of volume to weight), since high bulk tends to provide both softness and high power of absorption.

There have been many attempts to manufacture soft paper with substantially increased bulk. For instance. U.S. Pat. No. 3,806,406 describes a method and a device for forming of a soft paper web with high bulk. A wet web is fed on a felt through a roll nip comprising a press roll and a heated Yankee dryer. Because the pressing of the web tends to reduce the bulk, the mantle surface of the Yankee cylinder comprises alternately raised and lowered surface portions, which constitutes a relief pattern for placing against the web. Thus, only those parts of the web in contact with the raised surface portions are compressed, while the parts situated in between arc left relatively unaffected. The entire drying is done thermally through the supply of heat from the Yankee dryer, during which the soft paper web is held in a fixed position in relation to the raised and lowered surface portions. Accordingly, the web acquires a certain texture, i.e., a predetermined pattern of compressed and uncompressed surface portions, which surface portions match the relief pattern of the mantle surface. The web thereby also obtains an increased bulk.

However, the Yankee dryer has some disadvantages. One problem, as mentioned above, is that the Yankee dryer has a large diameter and therefore is very voluminous. Another problem is that when using a Yankee dryer it is difficult to achieve as high a temperature as can be achieved in hot pressing. Despite the fact that the steam within the drum may have a very high temperature, the drum mantle surface typically only reaches approximately 95° C. to 100° C. The mantle of the Yankee dryer must have a considerable thickness, typically approximately 50 to 100 mm, in order to be able to resist both the internal steam pressure and the external pressure against the mantle surface. The dryer thus represents a very large mass of material that must be heated up, and the thick mantle effectively blocks the thermal flow from the drum interior to the exterior mantle surface, leading to high energy consumption and attendant high cost of operation. Another problem is that it is difficult to maintain the desired geometrical shape of the roll in the cross machine direction on an account of difficulties in maintaining the same temperature along the mantle surface of the roll and on the gables. Since the mantle surface and the gables cannot expand freely and independently of each other, large tensions occur between these components, and hence the mantle surface often tends to become arc-shaped, outwardly or inwardly, across the machine direction.

U.S. Pat. No. 5,830,316 discloses an apparatus and method for drying and imprinting a wet web in which the web is passed through a wet press nip in which the web receives an imprinted structure. The web is then moved with the imprinted structure substantially maintained to a drying section in which the web is dried, which drying section can comprise a through-blow dryer and an Yankee cylinder, from the latter of which the dried web must be creped. There is an unavoidable open draw downstream of the creping doctor before the web can be reeled up, which is undesirable because of the increased risk of web breakage. Furthermore, the wet press tends to rewet the web.

Another process for drying a soft paper web is described in U.S. Pat. No. 5,556,511. A soft paper web is moved together with a felt for absorption of liquid from the web through a press zone, and the web is heated before or inside the press zone. The sudden expansion of the steam in the web when said web leaves the press zone is said to cause a delamination, which improves the volume and the softness in the web. i.e., increases the bulk of the web. Still more thermal drying can be performed after the web leaves the press zone by means of further drying devices such as a drying cylinder. Since the drying cylinder has a smooth mantle surface, to which the web easily sticks, the dried web is detached by creping from the drying cylinder by means of a creping blade. A drawback of this process is that the creped structure of the web tends to be lost after the web has absorbed water. Another disadvantage is that an unavoidable open draw is created from the creping blade to the reel-up, across which the web must be transferred before any final reeling can be done.

SUMMARY OF THE INVENTION

The above needs are met and other advantages are achieved by the present invention, which provides an apparatus and method for imprinting, drying, and reeling a fibrous web that enables a substantial reduction in the total machine length eliminates the remaining transfers and open draws for the web between the press section and the completed paper roll formed in the reel-up of the machine, and at least substantially reduces the problems of rewetting of the web in the press section, high heating costs, and poor retention of the desired structure of the imprinted web upon wetting of the dried web.

In accordance with a preferred embodiment of the invention, a method for imprinting, drying, and reeling a web includes the steps of passing the web through a nip defined between a pair of press members with one side of the web in contact with a surface of a clothing that also passes through the nip, and passing a heat transfer device through the nip along with the web and clothing. The heat transfer device defines a heatable surface in contact with the opposite side of the web during the web's passage through the nip, and the surface of the clothing, or the heatable surface of the heat transfer device, or both, comprises an imprinting surface for imprinting the web when the web is pressed in the nip. The method further includes the steps of heating the heat transfer device such that the heat transfer device heats and dries the web during contact therewith, supporting the web on the heat transfer device as the heat transfer device passes through the nip and travels a path from the nip to a rotatable reel spool or core shaft onto which the web is reeled to form a finished roll of web material, and transferring the web from the heat transfer device onto the reel spool at a location proximate thereto such that the web is supported by the heat transfer device along substantially the entire path from the nip to the reel spool. Preferably, the reeling of the web is performed with the reel spool against the heat transfer device such that the web is transferred directly from the heat transfer device onto the reel spool. Accordingly hot pressing of the web in the nip substantially reduces the problem of rewetting of the web upon exiting the nip and achieves a high degree of dewatering of the web. Moreover, the machine arrangement becomes entirely free from open draws and transfers from the press section to the finished material reel, and the machine arrangement can be made very compact.

An apparatus for imprinting, drying, and reeling a fibrous web in accordance with a preferred embodiment of the invention comprises a hot press including a pair of press members forming a nip therebetween for passage of the web therethrough and at least one clothing arranged to pass through the nip of the press with one side of the web in contact with a surface of the at least one clothing. The apparatus also includes a heat transfer device defining a heatable surface, the heat transfer device being arranged to pass through the nip of the press with the opposite side of the web in contact with the heatable surface, and a heating device operable to heat the heat transfer device such that the heat transfer device heats and dries the web during contact therewith. The apparatus further includes a reel-up including a rotatable reel spool or core shaft onto which the web is reeled to form a finished roll of web material. At least one of the clothing surface and the heatable surface comprises an imprinting surface for imparting a textured surface to the side of the web in contact therewith when the web, clothing, and heat transfer device are passed through the nip of the hot press. The heat transfer device is arranged to support the web from the press substantially to the reel spool.

Various configurations can be used for the heat transfer device. In one embodiment, a first of the press members of the hot press comprises a surface winding drum having a generally cylindrical outer surface and being rotatable about a central axis thereof, and the heat transfer device and the surface winding drum comprise one and the same member. Thus, the generally cylindrical outer surface of the surface winding drum comprises the heatable surface that is heated by the heating device, and the reel spool of the reel-up is disposed proximate the surface winding drum for receiving the web therefrom after the web's passage through the nip. Preferably, the reel spool is against the Web on the surface winding drum such that the reeling of the web is performed against the surface winding drum.

The generally cylindrical outer surface of the surface winding drum can comprise an imprinting surface for imprinting the side of the web in contact therewith. Additionally or alternatively, the at least one clothing can include an imprinting fabric in contact With the web for imprinting the side of the web in contact therewith as the web and imprinting fabric pass through the nip. Where the imprinting fabric is used, the surface of the surface winding, drum can be smooth or can have an imprinting pattern. Thus, either or both sides of the web can be imprinted in the hot press. Generally, the at least one clothing will also include an absorbent fabric for absorbing water pressed from the web as the web and absorbent fabric pass through the nip.

The heating device preferably includes at least a first heater disposed proximate the outer surface of the surface winding drum for heating the drum surface ahead of the nip. The heating device can also include at least a second heater disposed proximate the outer surface of the surface winding drum after the nip for healing the web carried on the drum surface.

In accordance with another embodiment of the invention, a first of the press members comprises a generally cylindrical roll rotatable about a central axis thereof, and the heat transfer device is formed separately from the rotatable roll and is configured as a closed loop loosely encircling the rotatable roll, the roll frictionally engaging the heat transfer device at the nip so as to rotatably drive the heat transfer device. The heat transfer device in one preferred embodiment comprises a substantially rigid sleeve. By substantially rigid is meant that the sleeve has sufficient rigidity to maintain its desired round shape during use even though the sleeve is substantially unsupported by the roll over most of the sleeve's circumference. Preferably, the sleeve forms a nip with the reel spool about which the web is wound in the reel-up. Thus, reeling of the web is performed directly against the sleeve.

An outer surface of the sleeve that contacts the web can comprise an imprinting surface for imprinting the web. Additionally or alternatively, the at least one clothing of the hot press can include an imprinting fabric in contact with the web in the nip for imprinting the web. Thus, either or both sides of the web can be imprinted.

In another preferred embodiment of the invention, the heat transfer device comprises a flexible belt looped about the rotatable roll and about at least one additional guide roll. The outer surface of the belt that contacts the web can comprise an imprinting surface for imprinting the web, and/or the at least one clothing can include an imprinting fabric in contact with the web in the nip for imprinting the web, whereby either or both sides of the web can be imprinted. The apparatus can also include a blowing device disposed proximate the reel-up for blowing a gaseous fluid against the web to aid in separating the web from the belt so that the web can be wound onto the reel spool. The belt can be permeable and the blowing device can be disposed inside the loop of the belt.

In accordance with another embodiment of the invention, a first of the press members of the hot press comprises a generally cylindrical roll rotatable about a central axis thereof and a substantially rigid sleeve loosely encircling the rotatable roll, and the heat transfer device comprises a flexible belt looped about the sleeve and about at least one additional guide roll, the rotatable roll frictionally engaging the sleeve at the nip to rotatably drive the sleeve and the sleeve frictionally engaging the belt to rotatable drive the belt. An outer surface of the belt in contact with the web can comprise an imprinting surface for imprinting the web, and/or the at least one clothing can include an imprinting fabric in contact with the web for imprinting the web, whereby either or both sides of the web can be imprinted.

The present invention facilitates a substantially shortened total machine length compared with existing machine designs. Moreover, the energy consumption of the machine can be reduced relative to conventional machines employing Yankee dryers, through-air dryers, and/or several drying cylinders. The web furthermore is dried without creping, and yet a web with a high bulk is produced by virtue of the imprinting in the hot press, which bulk remains after rewetting of the web, with qualities similar to those obtained by drying the web in a through-air dryer.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
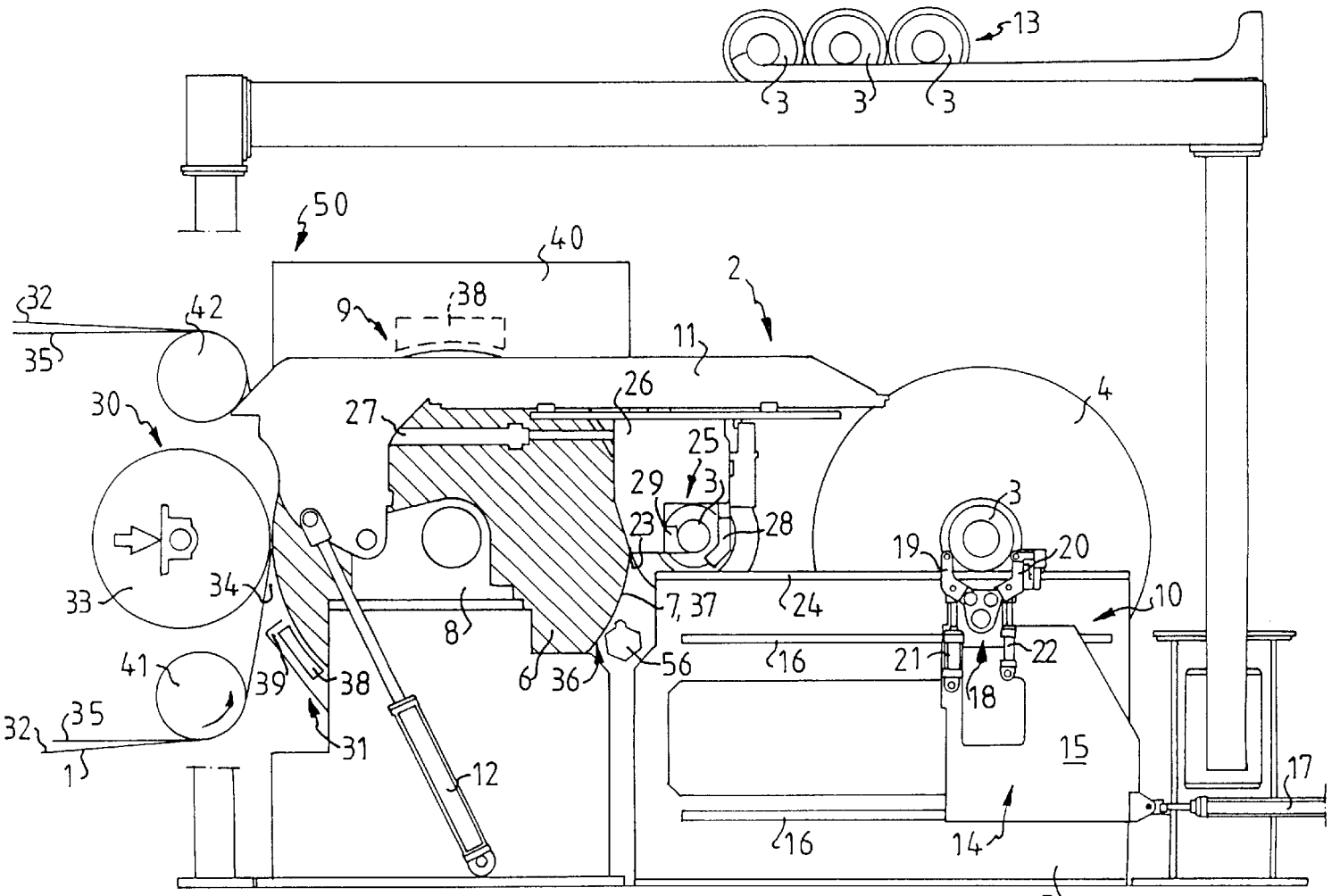
FIG. 1 is a schematic side view of an apparatus in accordance with a first embodiment of the invention.

FIG. 1 shows schematically and in side view parts of a machine arrangement in a paper machine for production of a continuous web 1 of fiber material with a cellulose content, preferably a soft paper web, according to a first embodiment of the invention. The machine arrangement comprises a reel-up 2 for reeling the web 1 on reel spools 3 into completed material reels 4. Throughout the present specification and claims, the term "reel spool" is meant to encompass any type of core onto which paper can be wound, including a metal core shaft having a tubular fibrous core sleeved thereover, a core shaft without any core, or the like. Furthermore, the term "material reel" is meant to encompass both paper wound about a tubular core, as well as paper wound into a roll without any tubular core. The reel-up 2 comprises two identical, elongated and spaced-apart parallel stand members 5, of which only one is shown, for supporting the reel spool 3 at its opposite ends. The reel-up also includes a surface winding drum 6 arranged between the stand members 5 at the upstream end of the reel-up 2, seen in the feed direction of the web 1. In the embodiment shown in FIG. 1, the surface winding drum 6 has a smooth mantle surface 7 over which the web 1 is arranged to run to one of the reel spools 3 or the material reel 4 being formed thereon. The surface winding drum 6 is rotatably journalled at two bearing houses 8, which are located one at each of the stand members 5. A drive motor (not shown) drives the surface winding drum 6 at a peripheral speed that generally equals the forward feeding speed of the web 1. The diameter of the surface winding drum 6 is approximately in the range of about 1.0 to 3.0 m.

Further. the reel-up 2 preferably has two systems for maintaining a continuous production of reeled web 1, namely a primary system 9 that receives new, empty reel spools 3 and begins winding the web onto an empty reel spool, and a secondary system for taking over the reel spool 3 from the primary system 9 with the material reel 4 commenced thereon for continued reeling to produce a finished material reel 4. The primary system 9 is arranged to transfer the reel spool 3 along the periphery of the surface winding drum 6 down to the horizontal stand members 5, where the secondary system 10 takes control of the reeling.

Figure 2:
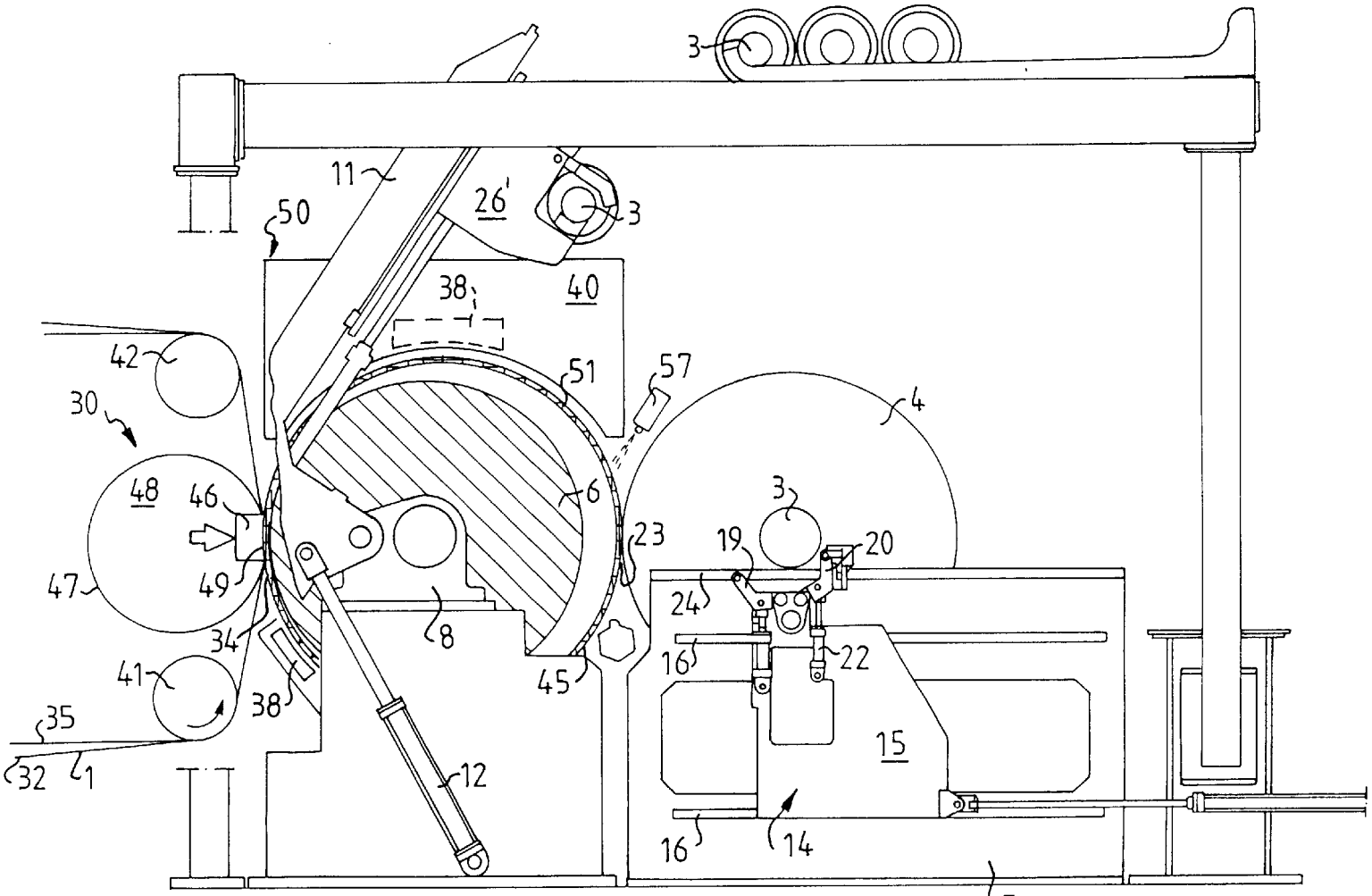
FIG. 2 is a schematic side view of an apparatus according to a second embodiment of the invention.

The primary system 9 comprises a pair of elongated primary arms 11 which are parallel with each other, which are pivotably arranged at each stand member 5 at the bearing house 8 of the surface winding drum 6 by means of two actuators 12. The primary arms 11 are shown in FIG. 1 and 2 with certain parts removed in order to better visualize hidden details of the machine arrangement. A store 13 of empty reel spools 3 is arranged at the upstream end of the reel-up 2 and above the surface winding drum 6, from which drum store 13 the primary arms 11, in the illustrated embodiment, are arranged to transfer an empty reel spool 3 for placing against the web 1 which is running over the driven surface winding drum 6 for the starting of the web 1 reeling when the growing material reel 4 located downstream approaches a predetermined size. Alternatively, in an unillustrated embodiment, a pair of lowering, arms can be arranged instead at the roll store 13, by which lowering, arms the reel spool 3 is arranged to be transferred to the primary arms 11 before being placed against the surface winding drum 6. The secondary system 10 comprises, in the embodiments shown in FIGS. 1 and 2, a pair of secondary carriages 14, which are arranged to be linearly displaceable alone the outer sides of the stand members 5 as the diameter of the growing material reel 4 increases. Instead of secondary carriages 14 the secondary system 10 can comprise a pair of secondary arms (not shown), which then are pivotally arranged, one at each of the stand members 5, for pivoting in synchronism with the diameter increase of the material reel 4.

Each secondary carriage 14 comprises a vertical platform 15 and bearings mounted on the side thereof that is turned towards the respective stand member 5 for cooperation with tracks 16 that are arranged at the stand member 5. Each secondary carriage 14 further comprises an actuator 17 for enabling the linear back and forth movements of the secondary carriage 14. The actuator 17, which for instance can comprise a hydraulic or pneumatic cylinder, is attached between the secondary carriage 14 and the stand member 5. The movements of the two secondary carriages 14 alone, the tracks 16 are synchronized with each other. Each secondary carriage 14 comprises a maneuverable gripper 18 for receiving and gripping the reel spool 3, which gripper 18 is arranged at the exterior of the platform 15. Each gripper 18 comprises a locking arm 19 and a pressing arm 20 arranged downstream in relation to the locking arm 19, which arms 19, 20 are arranged pivotally at the secondary carriage 14 and which arms 19, 20 each have an actuator 21, 22. The pressing arm 20 is arranged to press against the end part of the reel spool 3 for maintaining a predetermined linear pressure in the nip between the surface winding drum 6 and the material reel 4, also designated below as the first roll nip 23, during the size increase of the reel. Along the upper edge of each of the stand members 5 is a horizontal rail 24. The two rails 24, which are parallel, are intended to support the reel spool 3 at its end parts during the movement of the secondary carriage 14 in direction from the surface winding drum 6. Alternatively, the reel spool 3 can instead rest on a separate rail element (not shown) arranged horizontally at each upper edge of the secondary carriage 14 during the actual reeling in the secondary system 10, after which the reel spool can be transferred to the rails 24 for forwarding out of the reel-up 2 when the material reel 4 is completed. A center drive device (not shown) can be mounted on one of the secondary carriages 14 for driving of the reel spool 3 which is held in the grippers 18. Thus the center drive device is linearly displaceable to(ether with said secondary carriage 14 in a direction parallel with the rails 24. The primary system 9 can in the same manner also be equipped with a center drive device (not shown) for an initial acceleration of the reel spool and thereafter for maintaining the same peripheral speed at the reel spool 3 as at the surface winding drum 6, whereby unwanted frictional forces in the roll nip 23 are avoided.

In a similar manner, each of the primary arms 11 comprises a maneuverable gripper 25 for the seizure and holding of each new reel spool 3 during its transportation downwards into contact with the surface winding drum 6 and during its continued movement along the periphery of the surface winding drum 6, further down to the rails 24 of the stand members 5 or to the separate rail elements mentioned above. The gripper 25 is arranged at a primary carriage 26, which is linearly movable along the primary arm 11 by means of an actuator 27, which linear movement is effected to accommodate the increase in diameter of the growing material reel 4 on the reel spool 3 during the initial reeling in the primary system 9 and the necessary change of the gripper 25 position along the primary arm 11 at the movement along the surface winding drum 6. Each primary gripper 25 comprises a locking arm 28 and a pressing arm 29, of which at least the locking arm 28 is maneuverable by means of an actuator (not shown) for an opening or a locking movement of the gripper 25.

The machine arrangement further comprises a press 30 arranged in proximity to and upstream of the surface winding drum 6, and a drying arrangement 31 for drying of the web 1, which press 30 and drying arrangement 31 are integrated with each other in the form of a hot press 50 with a nip 34, and at least one clothing that leads the web 1 through the nip 34. In order to achieve wet embossing of the web 1, there should be at least one imprinting surface against the web 1 as the web passes through the nip 34. The imprinting surface in different embodiments can comprise a surface of a "pattern carrier", as an embossing wire 32 or a process belt, and/or a surface of the drying arrangement 31. In this context "pattern carrier" denotes a device arranged to give a wet web (i.e., before the essential drying of the web has taken place such that the fibers of the web are capable of being rearranged by pressing against the pattern carrier) a certain texture, namely a pattern imprinting, which imparts an embossed pattern of compressed and uncompressed surface portions that match the pattern of the pattern carrier in question. The web thereby receives a desirable increased bulk relative to a web that is wet pressed against smooth press surfaces. In accordance with the invention, the imprinted web is subsequently dried in such a manner that the imprinted structure is maintained during the drying. Accordingly, the structure remains even after the web has absorbed water. Thus. "wet web" means that the web has a low enough dry solids content in order to allow remolding of fibers in the web in the passage through the nip 34, so that the web acquires a structure with areas of different density.

The press 30 is particularly desirable in a paper machine for producing paper with low grammage such as tissue or the like. However, the paper machine can be designed for producing various paper grades. The press 30 comprises a press device 33 for pressing in cooperation with a rotatable roll 6 so as to form the nip 34 therebetween. In the embodiments of FIGS. 1, 4, and 6, the rotatable roll 6 comprises a surface winding drum against which reeling is performed in the reel-up. In other embodiments, the rotatable roll 6 is encircled by an additional element (e.g., a substantially rigid sleeve 45, see FIGS. 2, 3, 5, 7, or a flexible belt 54, see FIGS. 8–11) against which reeling is performed. The flip is formed against the upstream side of the rotatable roll 6. The press 30 includes at least one endless clothing that passes through the nip along with the web. The clothing usually consists of a press felt 35 having a substantially smooth surface, but can also consist of an embossing wire 32 that either is permeable with continuous openings and possibly cavities located or extending between these openings, or is impermeable and has cavities with a suitable and finite depth, shape and extension. Such cavities exist on the side of the wire that is closest to the web 1. In certain embodiments of the invention, further described below, the clothing of the press 30 (see for instance FIG. 7) is in the form of a press felt 35 for receiving and transporting away liquid from the web 1, and the felt 35 is arranged for passing through the roll nip 34 in direct contact with the web 1. The press felt 35 in this context can have a pattern carrying surface, when the openings and/or the cavities cause a certain impression in the form of an imprinted pattern in the web 1, which imprint increases the web 1 bulk.

In the various embodiments shown in FIGS. 1–11, the drying arrangement 31 comprises a movable heat transfer device 6 (FIG. 1), 45 (FIG. 2). 54 (FIGS. 8–11), that has a heatable surface 7 (FIG. 1), 51 (FIG. 2), 59 (FIGS. 8–11) for transfer of warmth to the web 1 for drying of the web to a predetermined dry solids content, and at least one heating device 38 for heating the movable heat transfer device to a desired operating temperature at startup and thereafter for a continuous heating during operation for maintaining this operating temperature. The web can be arranged to be preheated before the nip 34 by a suitable beating apparatus of different types, not shown. In the embodiment shown in FIG. 1, the mantle surface 7 of the surface winding drum 6 constitutes the heatable surface. Additional heating devices 38, one of which is indicated with dashed lines in FIGS. 1 and 2, can be arranged along the periphery of the surface winding drum 6 downstream of the nip 34 for after-drying of the web 1. Each heating device 38 call be either fixedly or immovably arranged, e.g. oscillating, at a predetermining position, or in relation to the roll nip 34 within a predetermined interval of space. If there are more than one heating device 38 these preferably are arranged on each side of the roll nip 34 against the press device 33. The heat transfer is thus arranged to happen chiefly during the passage of the web 1 through the roll nip 34, but also occurs during the rest of the travel of the web along the heatable surface of the beat transfer device. By virtue of the considerable heating in the roll nip 34 during the simultaneously applied high pressure, a swift and intense evaporation of water from the web 1 is obtained, by which the dry solids content of the web 1 increases substantially, in order to achieve the desired dry solids content of the web 1 in the subsequent drying performed after the nip 34, which is done free from external pressure during the transport of the web towards the reel spool 3. The linear pressure in the nip is approximately within the interval of 200–800 KN/m, preferably within the interval of approximately 300–600 KN/m, and the temperature is within the interval of approximately 200° C.–300° C., preferably at least 150° C. At the point of reeling on the reel spool 3, the web 1 has achieved a desired dry solids current tip to approximately 95%. Any suitable heating device 38 can be used, an induction heater currently being preferred. Examples of other heating devices 38 are electric and electro-magnetic heaters, infrared heaters, laser heaters and gas burners. The heating devices 38 can be arranged within one or several combustion chambers 39, see FIGS. 1 and 2, which are arranged along one sector of the rotatable roll 6 for each of said combustion chambers 39 and then suitably in front of or in proximity to the roll nip 34 against the press device 33. In the embodiments shown in the FIGS. 1 and 2, a hood 40 is arranged at the tipper side of the rotatable roll 6, which hood 40 extends along a substantial part of the periphery of the rotatable roll 6 between the hot press nip 34 and the nip 23 at the reel spool 3. The hood 40 is arranged to enclose one or several heating devices 38 for preventing energy loss and for evacuation of the steam emitted during the drying.

The clothing or the clothings, in the form of embossing wires 32 and/or press felts 35, are arranged to run in a closed loop about a number of rotatably journalled guide rolls 41, 42, which are arranged upstream of the rotatable roll 6 such that the wire and/or felt passes through the roll nip 34.

Each pattern carrying surface comprises, in relation to the surface of the web 1, imprinting elements 44 (FIGS. 4, 7) in the form of elevations, depressions and/or cavities which are arranged in a random or predetermined pattern on the side of the pattern carrying surface that faces the web 1 for generation of an impression in the form of an imprinted pattern imprint in the web 1. Depending on whether pattern carrying surfaces are arranged on one or on both sides of the web 1, the pattern imprinting of the web is single-sided or double-sided. Pattern carrying surfaces can comprise one of several alternative designs: for instance an embossing wire 32 with imprinting elements in the form of woven wire threads forming elevations and depressions in relation to the surface of the web, a process belt 35 with imprinting elements in the form of elevations and/or cavities of suitable size, shape and extension, or a relief patterned mantle surface 7 (see especially FIGS. 4 and 5) of the surface winding drum 6 having imprinting elements 44 comprising geometrical figures with suitable surface or shape. However, the apparatus can also comprise a heatable cylindrical, substantially rigid sleeve 45, see for instance FIG. 5, which loosely encircles the rotatable roll 6 and which can have an imprinted mantle surface 7 in the same manner as described for the surface winding drum 6.

The dimensions of the imprinting elements, seen in a cross-section through the surface winding drum, lies within an interval between approximately 0.1 and approximately 2.0 mm for the height of a specific imprinting element, i.e. the difference in radius between the top surface of the imprinting elements and the bottom surface of the cavities. The largest extension for a specific imprinting element in any direction along the mantle surface lies within an interval of approximately 0.5 to approximately 5 mm. Compared with a corresponding unimprinted web, the part of the surface of the imprinted web that is in direct contact with the top surfaces of the imprinting elements by way of the roll nip against the press device amounts to about 20–50%.

In the first embodiment shown in FIG. 1 of a machine arrangement according to the invention comprising a hot press 50 with heating devices 38 and press 30 integrated with a reel-up 2, which reel-up 2 especially comprises a surface winding drum 6 with smooth mantle surface 7, the press 30 consists of a roll press and the press device 33 consists of a cylindrical, smooth press roll for creating a conventional roll nip 34. The web is arranged to pass through the roll nip 34 with the press felt 35 and an embossing wire 32, the felt 35 being against the cylindrical roll 33, the embossing wire 32 being against the felt 35, and the web 1 being against the hot surface winding drum 6. The mantle surface 7 of the surface winding drum 6 is smooth such that the web is imprinted on only one side that is against the embossing wire 32. The smooth surface of the surface winding drum 6 can be doctored. The web 1 follows the smooth mantle surface 7 of the surface winding drum 6 downstream of the nip 34.

In the second embodiment shown in FIG. 2 of the machine arrangement according to the invention, the press 30 instead constitutes a shoe press with an extended nip 34 and the press device 33 comprises a press shoe 46 and an impermeable flexible mantle 47. Additionally, the rotatable roll 6 is axially enclosed by a loose sleeve 45 with a smooth mantle surface 51. The mantle 47 is rigidly mounted at rotatable peripheral gable parts 48 of the shoe press roll 33. The press shoe 46 has a concave surface 49 over which the mantle 47, the press felt 35, the embossing wire 32 and the web 1 are arranged to run together under sliding contact against the press shoe 46 for the mantle 47, under contact against the rotatable roll 6 and the sleeve 45. The concave surface 49 is thereby in pressure generating cooperation with the rotatable roll 6 by means of actuators (shown with a schematic arrow) for forming the extended nip 34. The web 1 is separated from the felt 35 and the embossing wire 32 after exiting the nip 34 and the web follows the sleeve 45 around a predetermined part of its mantle surface 51 instead.

Figure 3:
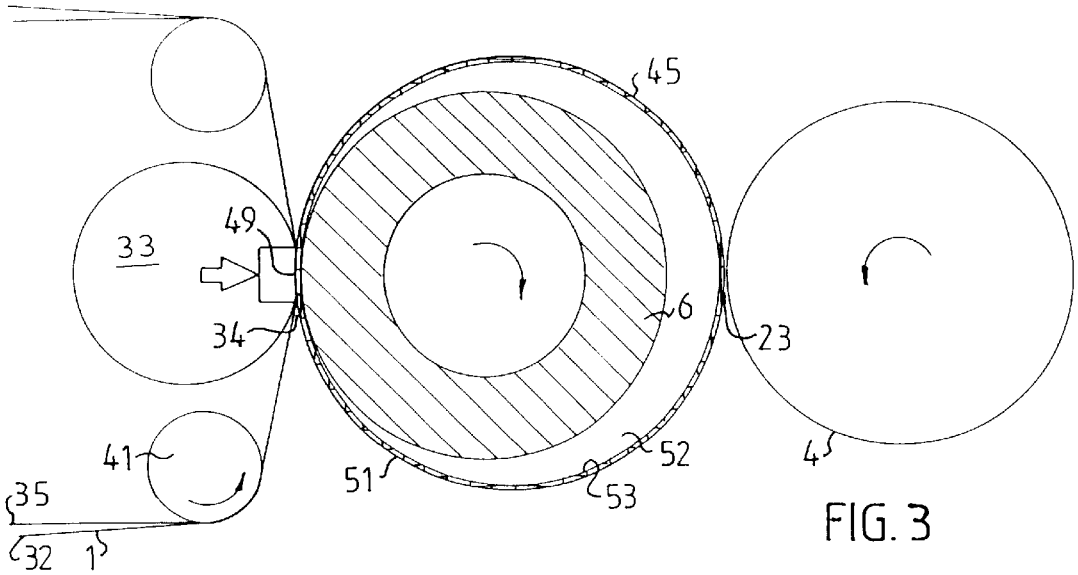
FIG. 3 is a schematic view of portions of the apparatus of FIG. 2.
Figure 4:
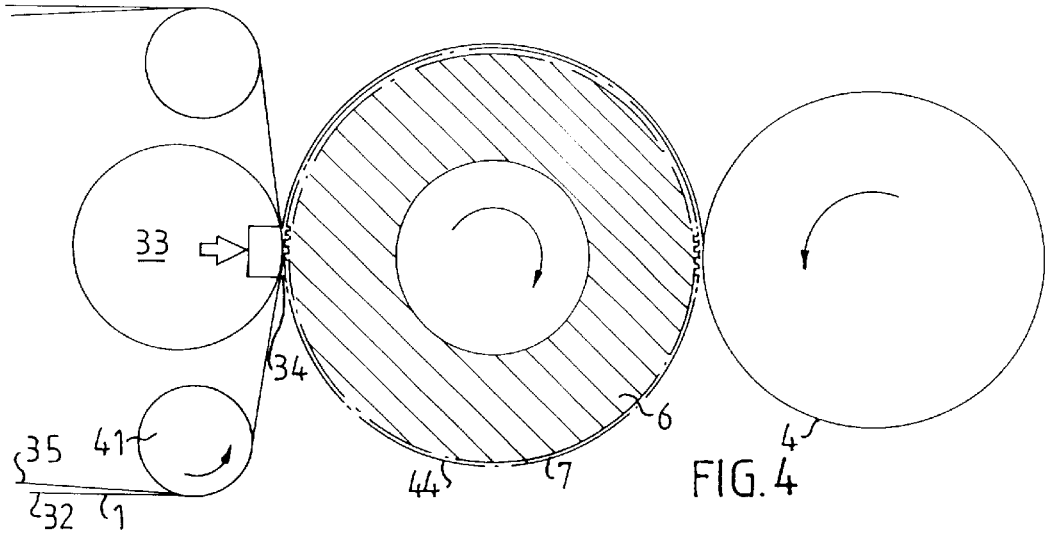
FIG. 4 is a view similar to FIG. 3, showing a third embodiment of the invention.

In the detail view shown in FIG. 3 of the machine arrangement according to FIG. 2, it is apparent that the heatable sleeve 45 is loosely arranged in relation to the rotatable roll 6. The sleeve 45 preferably is replaceable, and is substantially rigid such that it is form stable (i.e., it retains its desired round shape under the stresses encountered in use without being supported internally by the rotatable roll 6). The sleeve 45 is heatable from its outer surface 51 and encloses the rotatable roll such that, except in the roll nip 34, there is a radial play 52 between the sleeve and the rotatable roll over at least the entire operative axial portion of the rotatable roll 6. The sleeve is so arranged that it can expand freely in relation to the rotatable roll 6 upon heating before the roll nip 34 without thereby causing unfavorable tensions in the sleeve 45. The sleeve 45 has a circular cross-section with an interior 53, which is arranged to be forced into contact with the rotatable roll 6 within the zone for the roll nip 34. The outside 51 constitutes the mantle surface mentioned above, around which the web follows in contact from the inlet of the roll nip 34 and further to the reel spool 3 (FIG. 2) for reeling thereon. During operation the rotatable roll 6 is arranged to press the sleeve 45 firmly against the press device 33 to create a large enough friction force between the rotatable roll 6 and the sleeve 45 so that the sleeve 45 is rotated in the roll nip 34 by the driven rotatable roll 6 and at the same speed as the rotatable roll 6. During operation the sleeve 45 is arranged to rotate about its own axis of rotation, which is eccentrically located in relation to the axis of rotation of the rotatable roll 6. Furthermore, the machine arrangement according to the embodiment displayed in FIG. 3 includes a felt 35, an embossing wire 32 which transports a web 1 through the heated nip 34 imprinting the web 1 and a reel spool 3 (FIG. 2) in which a material reel 4 is under reeling against the mantle surface 51 of the sleeve 45. In this embodiment of FIG. 2 the press device 33 comprises a shoe press roll, but can instead consist of a press roll (see FIG. 1) which also goes for all other feasible embodiments of the invention. The linear load, i.e, the nip pressure in the first roll nip 23 between the mantle surface 51 of the sleeve 45 and the reel spool 3 is so much lower then the nip pressure in the roll nip 34 located upstream between the press device 33 and the sleeve 45 on the substantially opposed side of the sleeve 45 that the friction force for driving of the sleeve 45 is free of negative effects from it.

Generally with reference to FIGS. 2 and 3, the control of the nip pressure for the material reel 4 growing on the reel spool 3 in the first roll nip 23 located downstream of the surface winding drum 6, is performed through a cooperation between the actuators of the primary system 9 during the initial reeling, but, after the secondary system 10 has taken over the growing material reel 4, the control of the nip pressure in the first roll nip 23 is performed by the actuators of the secondary system 10. Respective pressing arm 20, 29 of the systems 9, 10 are thereby arranged to press against the end parts of the reel spool 3 for maintaining of a desired and controllable nip pressure during the entire increase in size of the material reel 4.

The reel spool 3 is driven with the same peripheral speed at the material reel 4 as the peripheral speed at the sleeve 45, so that frictional forces between the reel spool 3 and the sleeve 45 are minimized. The linear pressure caused by the contact of the reel spool 3 against the sleeve 45 is held within a predetermined and allowed ratio, in relation to the linear pressure in the nip 34, for maintaining a correct linear pressure and thereby also the desired friction between the sleeve 45 and the press device 33 for driving of the sleeve 45. The sleeve 45 has a sufficient wall thickness to resist the tensions which occur in the sleeve 45 in and on an account of the two roll nips 23, 34, so that the sleeve 45 maintains both its straightness cross machine and its radius all around, i.e. the wall thickness of the sleeve 45 is so chosen that the sleeve 45 is free from ovalities and axial deformations.

In FIG. 4 the third embodiment of the invention is shown, the machine arrangement comprising a shoe press roll 33 aver which a felt 35 is arranged to run for receiving and transporting water away from a web 1, an embossing wire 32, a relief patterned and heated surface winding drum 6, which relief pattern constitutes a second moveable pattern carrier for creating a heated roll nip 34 which imprints the web 1 on both sides, and a reel spool 3 (FIG. 2) on which a material reel 4 is reeled against the imprinted mantle surface 7 of the surface winding drum 6.

Figure 5:
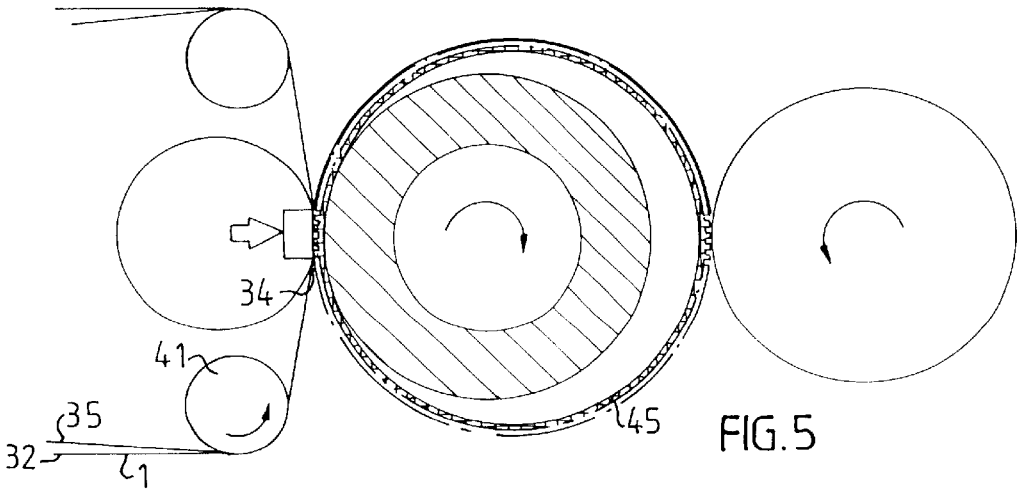
FIG. 5 is a view similar to FIG. 3, showing a fourth embodiment of the invention.
Figure 6:
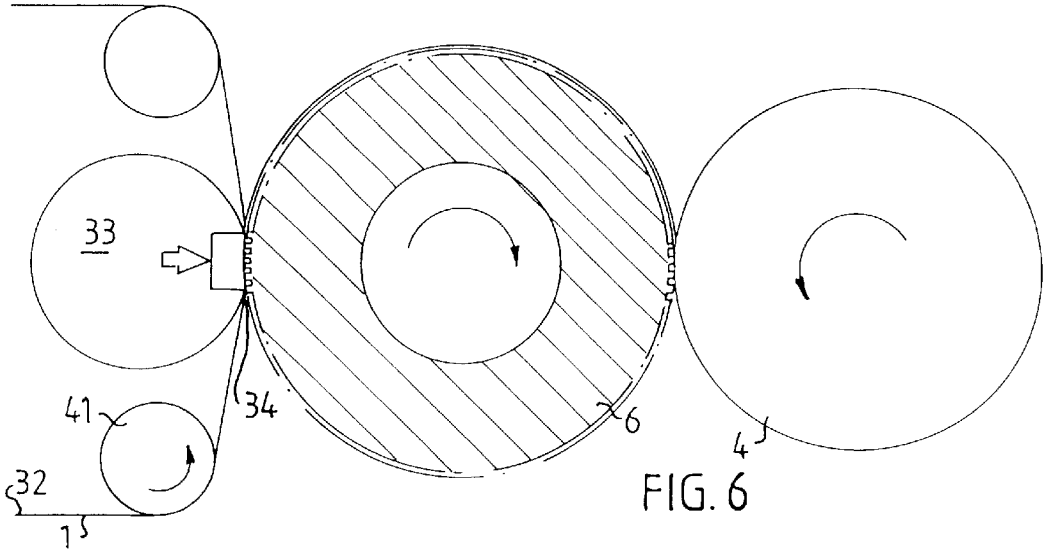
FIG. 6 is a view similar to FIG. 3, showing a fifth embodiment of the invention.

The fourth embodiment of the invention shown in FIG. 5 differs from the one shown in FIG. 4, in that it comprises a loose relief patterned and heated sleeve 45, which relief pattern constitutes a second pattern carrier for creating of a roll nip 34 imprinting the web 1 on both sides.

Figure 7:
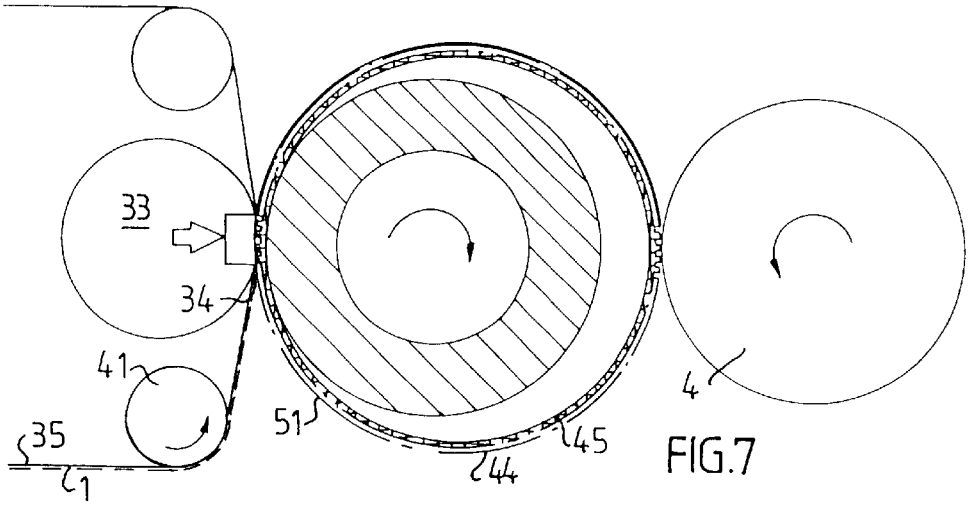
FIG. 7 is a view similar to FIG. 3, showing a sixth embodiment of the invention.
Figure 8:
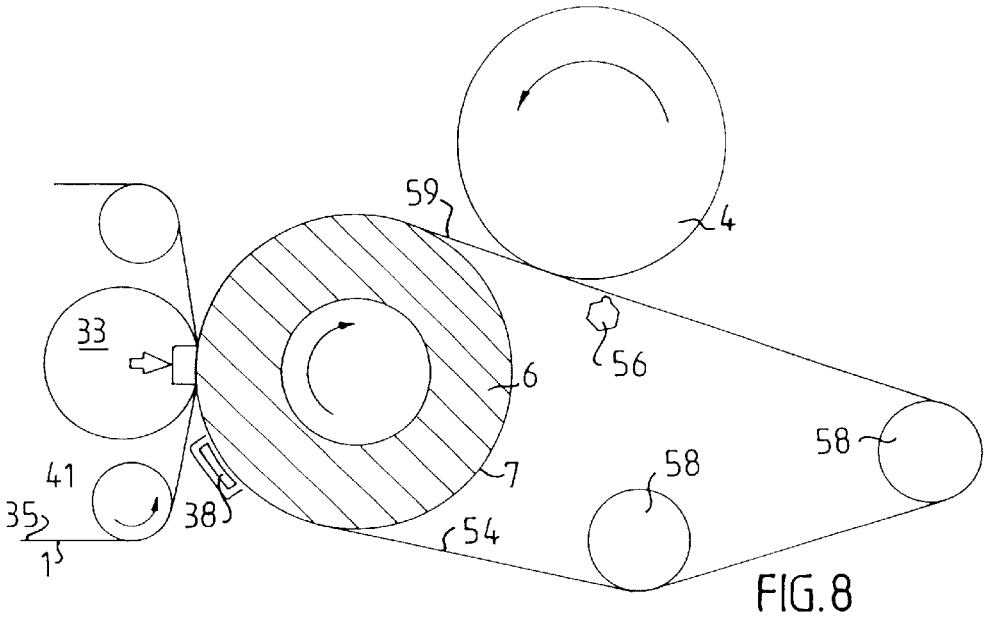
FIG. 8 is a view similar to FIG. 3, showing a seventh embodiment of the invention.

The embodiments of the invention shown in FIGS. 6 and 7 differ from those embodiments shown in FIGS. 4 and 5. in that the web 1 is arranged to follow a smooth clothing, for instance in the form of a press felt 35, in to the second roll nip 34 between the press device 33 and the surface winding drum 6 or between the press device 33 and the sleeve 45, for a single-sided imprinting of the web 1.

Figure 9:
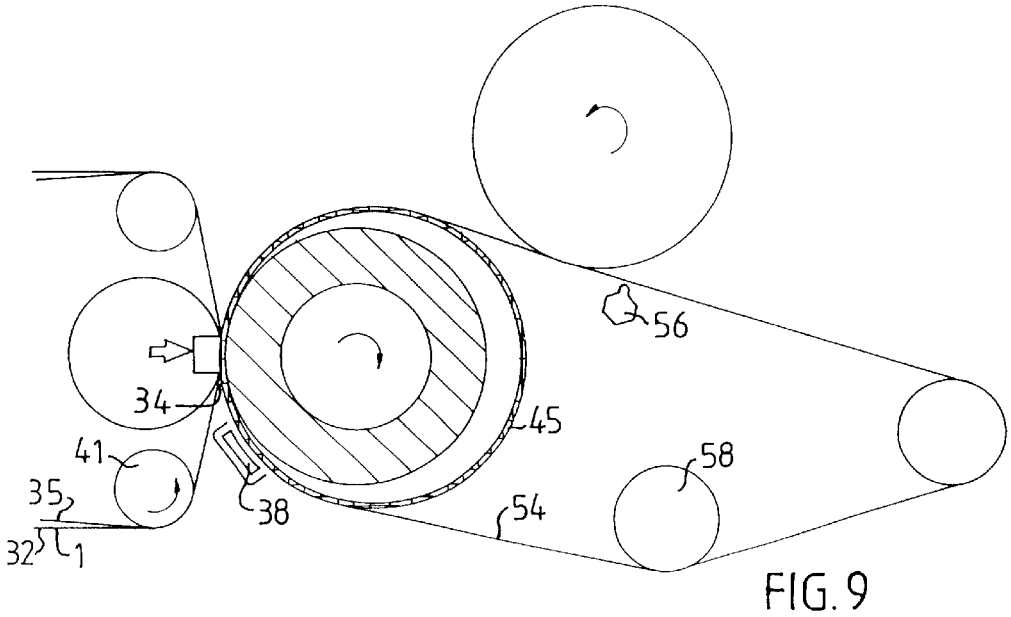
FIG. 9 is a view similar to FIG. 3, showing a eighth embodiment of the invention.
Figure 10:
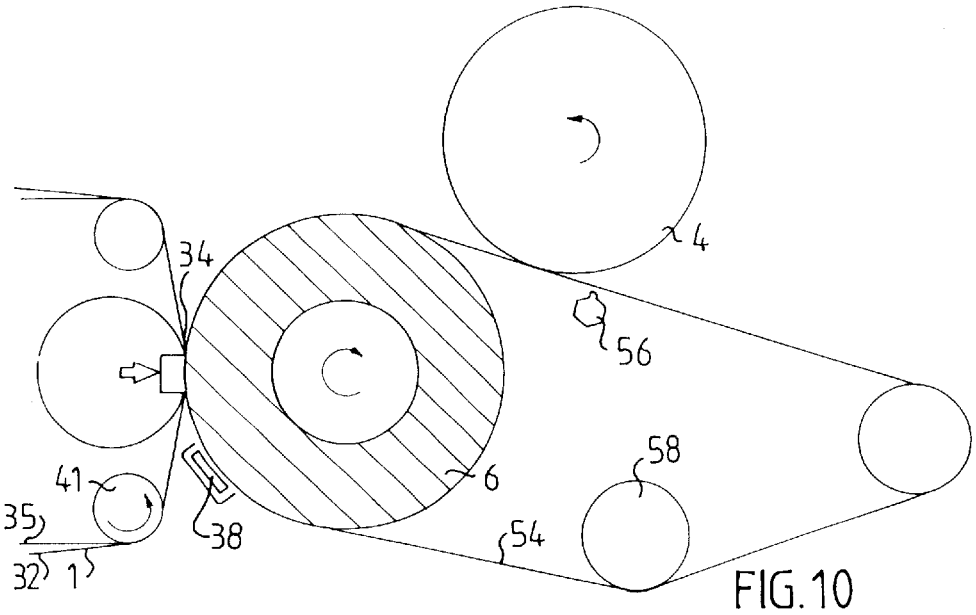
FIG. 10 is a view similar to FIG. 3, showing a ninth embodiment of the invention
Figure 11:
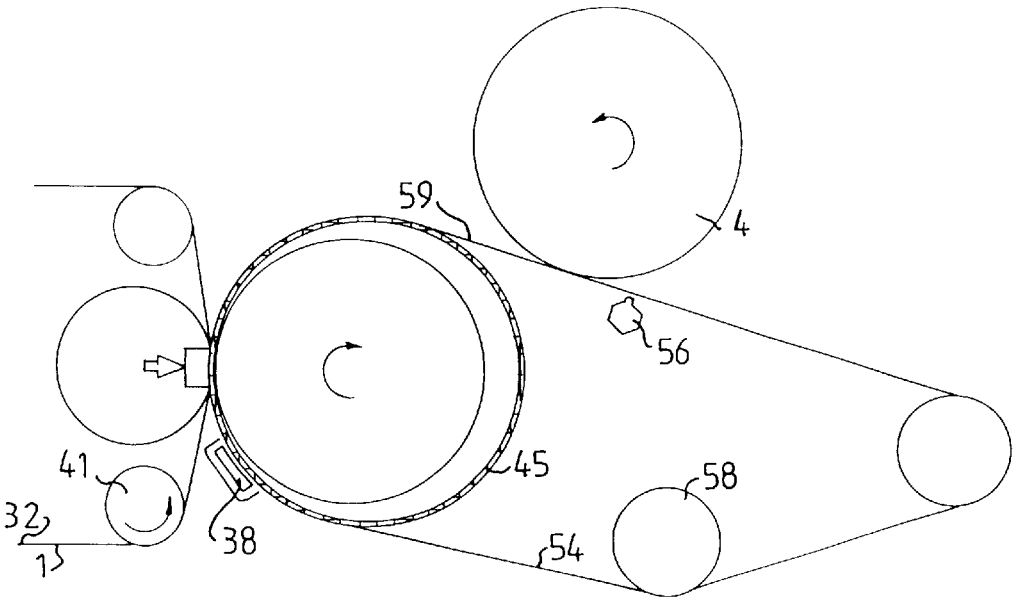
FIG. 11 is a view similar to FIG. 3, showing a tenth embodiment of the invention.

In the embodiments of the invention shown in FIGS. 8 to 11 the machine arrangement comprises a heatable, imprinted and endless pattern carrier, which for instance can comprise a belt 54 or the like, which pattern carrier is arranged in a loop around a rotatable roll 6 or around a sleeve 45 enclosing the rotatable roll 6, and around one or more additional guide rolls 58, in which the rotatable roll 6 and the sleeve 45 has a smooth mantle surface 7. The embodiments of the invention shown in FIGS. 8–11 differ with respect to the number of movable pattern carriers that is arranged for passage through the heated nip 34 for either a single-sided or double-sided pattern imprinting of the web 1 and the presence of a sleeve 45 around the rotatable roll 6. FIGS. 9 and 10 depict embodiments having an embossing wire 32 and can achieve a single-sided imprinting if the belt has a smooth surface, or a double-sided imprinting if the belt 54 is imprinted. If the belt 54 is impermeable, the spray nozzle 56 arranged within the web loop as depicted in FIGS. 8–11 is instead arranged outside the loop of the belt.

With reference to FIGS. 1, 2, and 8–11, a blowing apparatus is arranged in near proximity to and downstream of the outlet from the first roll nip 23 against the growing material reel 4, which blowing apparatus comprises one or several spray nozzles 56 for compressed air, so called air-knives, for considerable air blowing against the web 1 for facilitating the releasing of the web 1 from the supporting surface, which can consist of the mantle surface 7 of the surface winding drum 6 or the outer surface 51 of the sleeve 45 or the outer surface of the belt 54, and for cleaning of the same. Where the belt 54 is a permeable belt, the blowing apparatus can be arranged inside the loop of the belt as shown in FIGS. 8–11. Where the belt is an impermeable belt (which is not shown), the blowing apparatus and a possible doctor blade is instead arranged on the outside of the belt loop 54. However, at temperatures on the supporting surface from 250° C. and upward the web 1 loosens easily from the supporting surface. This is considered to be due to the high dry solids content obtained by the hot pressing of the web 1 and the steam pressure which occurs on the side of the web 1 which is turned towards the hot supporting surface. If so desired, the air jet can consist of or cooperate with the hot gases from a gas burner or the like. All residual fibers that remain stuck to the supporting surface will immediately be burnt to ashes and transferred away by the jet of gas. In addition, the heating of the supporting surface by means of the hot gases reduces the need of additional heating devices for the heating of the web. Brushes (not shown) can also be used for cleaning, if desired.

Thus, the invention provides an apparatus and method in which a reel-up 2 and a hot press 50 for producing a continuous imprinted web 1 with high bulk are integrated such that reeling occurs directly against a supporting surface of a heat transfer device that has a heatable surface that is heated and that passes through the nip of the hot press, and that then carries the web to the reel-up. The web is not creped from any drying cylinder. The web 1 runs free of open draws during the hot pressing and reeling, and a paper machine with a very compact design is achieved, when the need of a Yankee cylinder is removed. The resulting product comprises an creped paper web 1 with especially favorable properties mentioned above.

All the above-mentioned actuators can for instance comprise hydraulic or pneumatic cylinders. Finally, for ensuring the transfer of the web 1 to the reel spool 3, a gluing device 57 for application of an adhesive on either the web 1 or the reel spool 3 preferably is arranged before the roll nip 23 against the reel spool 3.

Many modifications and other embodiments of the invention will come to mind to one skilled in the art to which this invention pertains having the benefit of the teachings presented in the foregoing descriptions and the associated drawings. For example, while the illustrated embodiments have the surface of the surface winding drum 6 heated by a heating device external to the surface winding drum, it is also within the scope of the invention to instead heat the winding drum from the inside. This can be accomplished, for example, with a gas-fired IR heater or hot oil in heat-exchanging relationship with the drum shell. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for imprinting, drying, and reeling, a fibrous web, comprising:

a hot press including:

a pair of press members forming a nip therebetween for passage of the web therethrough;

at least one clothing arranged to pass through the nip of the press with one side of the web in contact with a surface of the at least one clothing;

a heat transfer device defining a heatable surface the heat transfer device being arranged to pass through the nip of the press with the opposite side of the web in contact with the heatable surface; and a heating device operable to heat the heat transfer device such that the heat transfer device heats and dries the web during contact therewith; and a reel-up including a rotatable reel spool onto which the web is reeled to form a finished roll of web material;

wherein at least one of the clothing surface and the heatable surface comprises an imprinting surface for imparting a textured surface to the side of the web in contact therewith, and wherein the heat transfer device is arranged to support the web between the press and the reel spool.

2. The apparatus of claim 1, wherein a first of the press members comprises a surface winding drum having a generally cylindrical outer surface and being rotatable about a central axis thereof, and wherein the heat transfer device and the surface winding drum comprise one and the same member, the generally cylindrical outer surface of the surface winding drum comprising the heatable surface that is heated by the heating device, and the reel spool of the reel-up being disposed proximate the surface winding drum for receiving the web therefrom after the web's passage through the nip.

3. The apparatus of claim 2, wherein the generally cylindrical outer surface of the surface winding drum comprises an imprinting surface for imprinting the side of the web in contact therewith.

4. The apparatus of claim 3, wherein the at least one clothing includes an imprinting fabric in contact with the web for imprinting the side of the web in contact therewith as the web and imprinting fabric pass through the nip, whereby both sides of the web are imprinted in the hot press.

5. The apparatus of claim 3, wherein the at least one clothing includes an absorbent fabric for absorbing water pressed from the web as the web and absorbent fabric pass through the nip.

6. The apparatus of claim 2, wherein the generally cylindrical surface of the surface winding drum is smooth and wherein the at least one clothing includes an imprinting fabric in contact with the web for imprinting the side of the web in contact therewith as the web and imprinting fabric pass through the nip, whereby only one side of the web is imprinted in the hot press.

7. The apparatus of claim 2, wherein the heating device includes at least a first heater disposed proximate the outer surface of the surface winding drum for heating said surface ahead of the nip.

8. The apparatus of claim 7, wherein the heating device further includes at least a second heater disposed proximate the outer surface of the surface winding drum after the nip for heating the web carried on said surface.

9. The apparatus of claim 1, wherein a first of the press members comprises a generally cylindrical roll rotatable about a central axis thereof, and wherein the heat transfer device is formed separately from the rotatable roll and is configured as a closed loop loosely encircling the rotatable roll, the roll frictionally engaging the heat transfer device at the nip so as to rotatably drive the heat transfer device.

10. The apparatus of claim 9, wherein the heat transfer device comprises a substantially rigid sleeve.

11. The apparatus of claim 10, wherein the sleeve forms a nip with the reel spool about which the web is reeled in the reel-up.

12. The apparatus of claim 10, wherein an outer surface of the sleeve that contacts the web comprises an imprinting surface for imprinting the web.

13. The apparatus of claim 12, wherein the at least one clothing includes an imprinting, fabric in contact with the web in the nip for imprinting the web.

14. The apparatus of claim 10, wherein an outer surface of the sleeve that contacts the web is smooth, and wherein the at least one clothing includes an imprinting fabric in contact with the web for imprinting the web.

15. The apparatus of claim 9, wherein the heat transfer device comprises a flexible belt looped about the rotatable roll and about at least one additional guide roll.

16. The apparatus of claim 15, wherein an outer surface of the belt that contacts the web comprises an imprinting surface for imprinting the web.

17. The apparatus of claim 16, wherein the at least one clothing includes an imprinting fabric in contact with the web in the nip for imprinting the web.

18. The apparatus of claim 15, wherein an outer surface of the belt that contacts the web is smooth, and wherein the at least one clothing includes an imprinting fabric in contact with the web for imprinting the web.

19. The apparatus of claim 15, further comprising a blowing device disposed proximate the reel-up for blowing a gaseous fluid against the web to aid in separating the web from the belt so that the web can be wound onto the reel spool.

20. The apparatus of claim 19, wherein the belt is permeable and the blowing device is disposed inside the loop of the belt.

21. The apparatus of claim 1, wherein a first of the press members comprises a generally cylindrical roll rotatable about a central axis thereof and a substantially rigid sleeve loosely encircling the rotatable roll, and wherein the heat transfer device comprises a flexible belt looped about the sleeve and about at least one additional guide roll, the rotatable roll frictionally engaging the sleeve at the nip to rotatably drive the sleeve and the sleeve frictionally engaging the belt to rotatably drive the belt.

22. The apparatus of claim 21, wherein an outer surface of the belt in contact with the web comprises an imprinting surface for imprinting the web.

23. The apparatus of claim 22, wherein the at least one clothing includes an imprinting fabric in contact with the web for imprinting the web.

24. The apparatus of claim 21, wherein an outer surface of the belt in contact with the web is smooth, and the at least one clothing includes an imprinting fabric in contact with the web for imprinting the web.

25. A method for imprinting, drying, and reeling, a fibrous web, comprising:

passing the web through a nip defined between a pair of press members with one side of the web in contact with a surface of a clothing that also passes through the nip;

passing a heat transfer device through the nip along with the web and clothing, the heat transfer device defining a heatable surface in contact with the opposite side of the web during the web's passage through the nip, at least one of the surface of the clothing and the heatable surface of the heat transfer device comprising an imprinting, surface for imprinting, the web when the web is pressed in the nip;

heating the heat transfer device such that the heat transfer device heats and dries the web during, contact therewith;

supporting, the web on the heat transfer device as the heat transfer device passes through the nip and travels a path from the nip to a rotatable reel spool onto which the web is reeled to form a finished roll of web material; and transferring, the web from the heat transfer device onto the reel spool at a location proximate thereto.

26. The method of claim 25, wherein reeling of the web is performed with the reel spool against the heat transfer device such that the web is transferred directly from the heat transfer device onto the reel spool.

* * * * *

UNITED STATES PATENT AND TRADEMARK OFFICE

CERTIFICATE OF CORRECTION

PATENT NO. : 6,398,909 B1
DATED : June 4, 2002
INVENTOR(S) : Klerelid

It is certified that error appears in the above-identified patent and that said Letters Patent is hereby corrected as shown below:

Column 2,
Line 12, after “side” the period (.) should be a comma (,);
Line 67, “arc” should read -- are --.

Column 4,
Line 3, after “length” insert a comma (,);
Line 35, after “Accordingly” insert a comma (,).

Column 5,
Line 9, “Web” should read -- web --;
Line 16, “With” should read -- with --;
Line 19, after “winding” cancel the comma (,);
Line 30, “healing” should read -- heating --.

Column 6,
Line 9, “rotatable” should read -- rotatably --;
Line 20, after “creping” cance the comma (,);
Lines 34, 40, 44, 48 and 51, after “invention” the colon (:) should be a semicolon (;);
Line 53, after “invention” insert a semicolon (;).

Column 7,
Line 31, after “Further” the period (.) should be a comma (,);
Line 35, after “system” insert -- 10 --;
Lines 57 and 58, after “lowering” cancel the comma (,);
Line 64, “alone” should read -- along --.

Column 8,
Line 13, “alone,” should read -- along --;
Line 39, “to(ether” should read -- together --.

Column 9,
Line 24, after “Thus” the period (.) should be a comma (,);
Line 40, “flip” should read -- nip --;
Line 61, after “(FIG.2)” the period (.) should be a comma (,).

UNITED STATES PATENT AND TRADEMARK OFFICE

CERTIFICATE OF CORRECTION

PATENT NO. : 6,398,909 B1
DATED : June 4, 2002
INVENTOR(S) : Klerelid

It is certified that error appears in the above-identified patent and that said Letters Patent is hereby corrected as shown below:

Column 10,
Line 2, “beating” should read -- heating --;
Line 9, “call” should read -- can --;
Line 10, “immovably” should read -- movably -- and “predetermining” should read -- predetermined --;
Line 17, “beat” should read -- heat --;
Line 31, “current” should read -- content --;
Line 32, “tip” should read -- up --;
Line 42, “tipper” should read -- upper --.

Column 12,
Line 33, “then” should read -- than --.

Column 13,
Line 1, “aver” should read -- over --;
Line 15, after “5” the period (.) should be a comma (,);
Line 19, after “6” insert a comma (,);
Line 31, “web 1” insert a comma (,).

Column 14,
Line 12, “creped” should read -- uncreped --;
Line 38, after “reeling” cancel the comma (,);
Line 46, after “surface” insert a comma (,).

Column 15,
Line 19, after “smooth” insert a comma (,);
Line 49, after “imprinting”, cancel the comma (,).

UNITED STATES PATENT AND TRADEMARK OFFICE

CERTIFICATE OF CORRECTION

PATENT NO. : 6,398,909 B1
DATED : June 4, 2002
INVENTOR(S) : Klerelid

It is certified that error appears in the above-identified patent and that said Letters Patent is hereby corrected as shown below:

Column 16,
Line 34, after "reeling" cancel the comma (,);
Line 46, after "imprinting", both occurrences, cancel the commas (,);
Line 49, after "during" cancel the comma (,);
Line 51, after "supporting" cancel the comma (,);
Line 56, after "transferring" cancel the comma (,).

Signed and Sealed this

Nineteenth Day of November, 2002

*Attest:*

*Attesting Officer*

JAMES E. ROGAN
*Director of the United States Patent and Trademark Office*